US008250793B1

(12) United States Patent
Halula

(10) Patent No.: US 8,250,793 B1
(45) Date of Patent: Aug. 28, 2012

(54) MULTI-IMAGE PERSONALIZED LICENSE PLATE DISPLAY APPARATUS

(76) Inventor: Robert Halula, Boca Raton, FL (US)

( * ) Notice: Subject to any disclaimer, the term of this patent is extended or adjusted under 35 U.S.C. 154(b) by 138 days.

(21) Appl. No.: 12/790,832

(22) Filed: May 30, 2010

Related U.S. Application Data

(60) Provisional application No. 61/182,747, filed on May 31, 2009.

(51) Int. Cl.

| | |
|---|---|
| ***G09F 11/02*** | (2006.01) |
| ***G09F 7/00*** | (2006.01) |
| ***G09F 13/02*** | (2006.01) |
| ***G09F 13/08*** | (2006.01) |
| ***G09F 7/02*** | (2006.01) |
| ***G09F 13/16*** | (2006.01) |
| ***G09F 7/22*** | (2006.01) |

(52) U.S. Cl. ..... 40/503; 40/200; 40/201; 40/202; 40/203; 40/204; 40/205; 40/206; 40/207; 40/208; 40/209; 40/210; 40/211

(58) Field of Classification Search ..... 40/200–211, 40/503

See application file for complete search history.

(56) References Cited

U.S. PATENT DOCUMENTS

| | | | | |
|---|---|---|---|---|
| 1,461,047 | A * | 7/1923 | Ray | 40/505 |
| 2,635,227 | A * | 4/1953 | Liotta | 340/488 |
| 4,638,580 | A * | 1/1987 | Giannetti et al. | 40/503 |
| 5,161,421 | A * | 11/1992 | Stigsson | 74/84 R |
| 5,511,330 | A * | 4/1996 | Havens | 40/505 |
| 5,933,990 | A * | 8/1999 | Keyser et al. | 40/472 |
| 6,128,841 | A * | 10/2000 | Werner | 40/505 |
| 6,295,882 | B1 * | 10/2001 | Osterberg | 74/84 R |
| 7,257,913 | B2 * | 8/2007 | Heller et al. | 40/503 |
| 2003/0142044 | A1 * | 7/2003 | Berry | 345/55 |
| 2004/0159025 | A1 * | 8/2004 | Chen | 40/505 |
| 2007/0199216 | A1 * | 8/2007 | Atkinson | 40/503 |
| 2008/0073169 | A1 * | 3/2008 | Walters | 192/70.2 |

* cited by examiner

*Primary Examiner* — Lesley D Morris

*Assistant Examiner* — Syed A Islam

(74) *Attorney, Agent, or Firm* — Allen D. Hertz, P.A.; Allen D. Hertz

(57) ABSTRACT

A multi-image license plate assembly having a series of horizontally disposed rotating display members operably controlled by a rotational drive mechanism. The drive mechanism can be a series of gears, pulleys, belts, chains, a worm gear assembly, or other means. The horizontally disposed rotating display members rotated about a horizontal axis. The rotating display members preferably have three image surfaces. An image is segmented, with each segment applied to a respective image surface of each of the display members, such that when the image surfaces are aligned, the complete image is displayed. The image can be applied directly to the rotating member or applied to an insert. An adapter mount is provided for fastening the multi-image license plate assembly to a vehicle.

19 Claims, 15 Drawing Sheets

MULTI-IMAGE PERSONALIZED LICENSE PLATE DISPLAY APPARATUS

CROSS REFERENCE TO RELATED APPLICATIONS

This application is a Non-Provisional Application of co-pending Provisional U.S. Patent Application Ser. No. 61/182,747, filed May 31, 2009, the contents of which are incorporated herein by reference into the present application.

FIELD OF THE INVENTION

The present disclosure generally relates to a personalized license plate. More particularly, the present disclosure relates to a personalized license plate having a plurality of images that can be remotely changed via a plurality of rotating members.

BACKGROUND OF THE INVENTION

It has been customary for vehicle owners to personalize their vehicles by installing custom license plates on the front of their vehicles. These custom license plates provide a means for expressing the person's interests, tastes, associations, businesses, and the like. Examples include a university plate, a business advertisement, a hobby association, and the like. The current configuration secures the single image license plate to the vehicle. This configuration limits the license plate to a single image.

Therefore, what is desired is a personalized license plate allowing the occupants to change the image as desired.

SUMMARY OF THE INVENTION

The present disclosure is generally directed to a multi-image license plate assembly providing a vehicle occupant the ability to change the presented image. The multi-image license plate comprising a plurality of rotating members having a plurality of image surfaces. The series of the rotating members rotate in a synchronized fashion, changing the presented image from a first image to a successive image. The plurality of images can be applied to the rotating members in any of a variety of methods.

In some embodiments, the multi-image license plate assembly may include:

an assembly frame having an image presentation side, which is sized approximate to that of a standard license plate;

a series of rotating display members, each rotating display member having a rotational axis disposed along a longitudinal center of each rotating display member;

each rotating display member being disposed horizontally within said assembly frame;

each rotating member having at least two image surfaces, wherein a lower image surface edge abuts an upper image surface edge of an adjacent image surface to provide a planar surface finish;

at least one visual image divided into segments with each segment disposed upon a respective image surface of the series of rotating display members, presenting the visual image when the rotating display members are positioned accordingly;

a rotational drive mechanism being operatively engaged to the series of rotating display members for intermittently rotating the series of rotating display members in a synchronized fashion for presenting a series of different images; and a mount for fastening said assembly frame to a license plate mount of a vehicle.

In another aspect, the rotating display members comprise three equal image surfaces forming a triangular shaped cross section.

In still another aspect, the rotational drive mechanism is a stepper motor.

In yet another aspect, the image is attached to the image surface via an adhesive.

In a still further aspect, the image is sized covering the entire viewing surface, adhered, then sliced along the seam between each of two adjacent image surfaces.

In another aspect, the image is placed upon an image insert, which is mechanically secured to a display frame member. The image can be printed, painted, adhered to, and the like, upon an image surface or an insert applied to the rotating display member.

In a still further aspect, the image is placed upon an image insert, which is mechanically secured to a display frame member via a sliding assembly, a snap assembly, a magnetic assembly, and the like.

In yet another aspect, the multi-image license plate assembly further comprises a remote control for remotely rotating the assembly between a displayed image and an adjacent image.

While in another aspect, the drive mechanism includes a motor segmented gear comprising a motor segmented gear toothed section and a motor segmented gear tooth-free section, a rotational member gear comprising a series of rotational member gear teeth disposed about the circumference of the rotational member gear. The rotational member gear being operationally engaged with the drive gear, wherein the rotational member gear rotates when the motor segmented gear toothed section engages with the rotational member gear teeth and maintains the rotational member assembly in a display position when the motor segmented gear tooth-free section passes across the rotational member gear teeth.

And in another aspect, a drive gear rotational member stabilizing cam is disposed upon a distal end of the motor segmented gear, the stabilizing cam having a stationary display broad radius cam section and a display rotating narrow cam section about a circumference and a stabilizing surface provided as a distal surface; and a three position display stabilizing cam disposed upon a distal end of the rotational member gear having three equilateral stabilizing cam engaging edge surfaces, wherein the stabilizing cam engaging edge surfaces are supported by the stabilizing surface to maintain the rotating member in a display orientation and wherein the three position display stabilizing cam rotates when aligned with the display rotating narrow cam section.

With yet another aspect providing a remote control that utilizes either wired or wireless communication between the remote control and the multi-image license plate assembly.

BRIEF DESCRIPTION OF THE DRAWINGS

The invention will now be described, by way of example, with reference to the accompanying drawings, where like numerals denote like elements and in which.

DETAILED DESCRIPTION OF THE INVENTION

Figure 3:
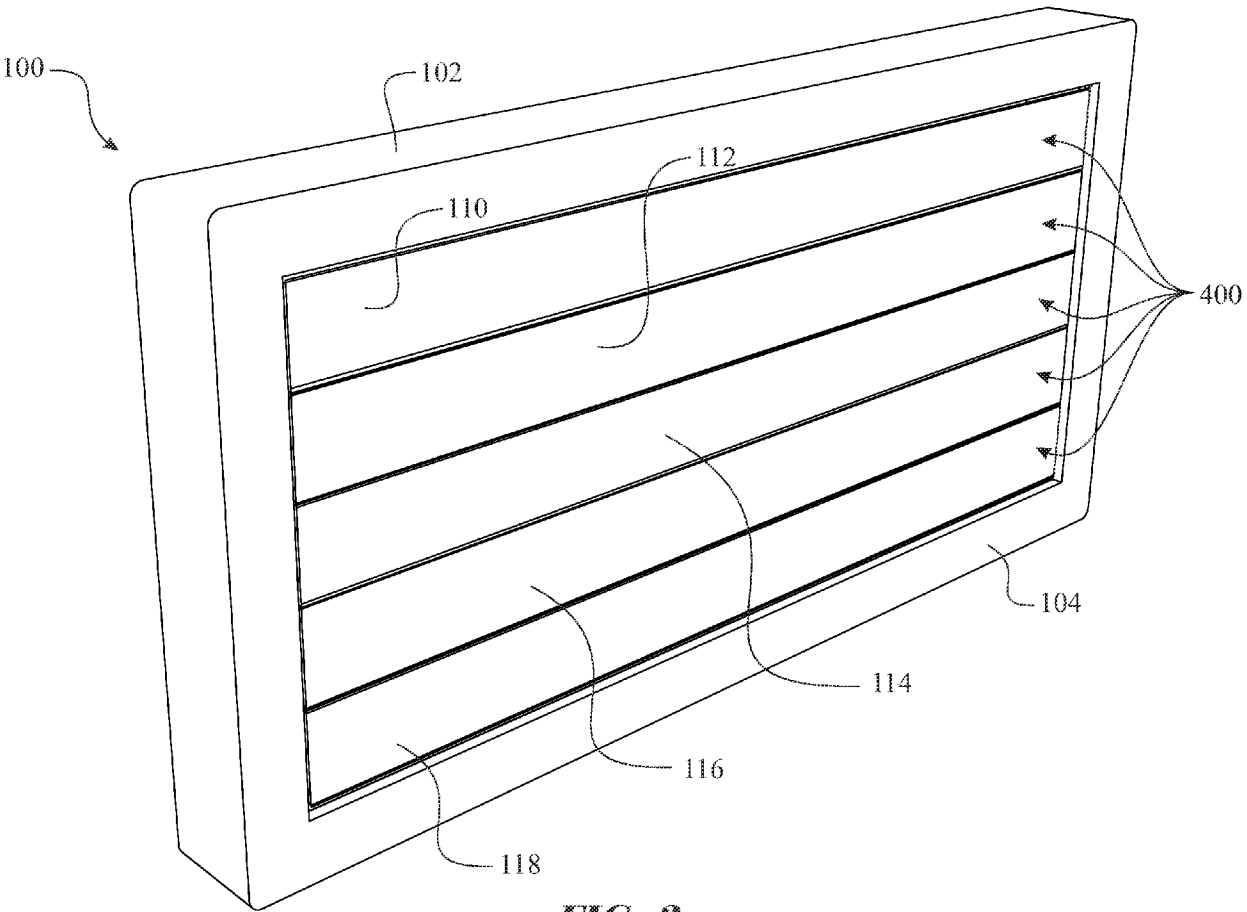
FIG. 3 illustrates a perspective front view of the illustrative embodiment of the multi-image license plate assembly presented in FIG. 2.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 3. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
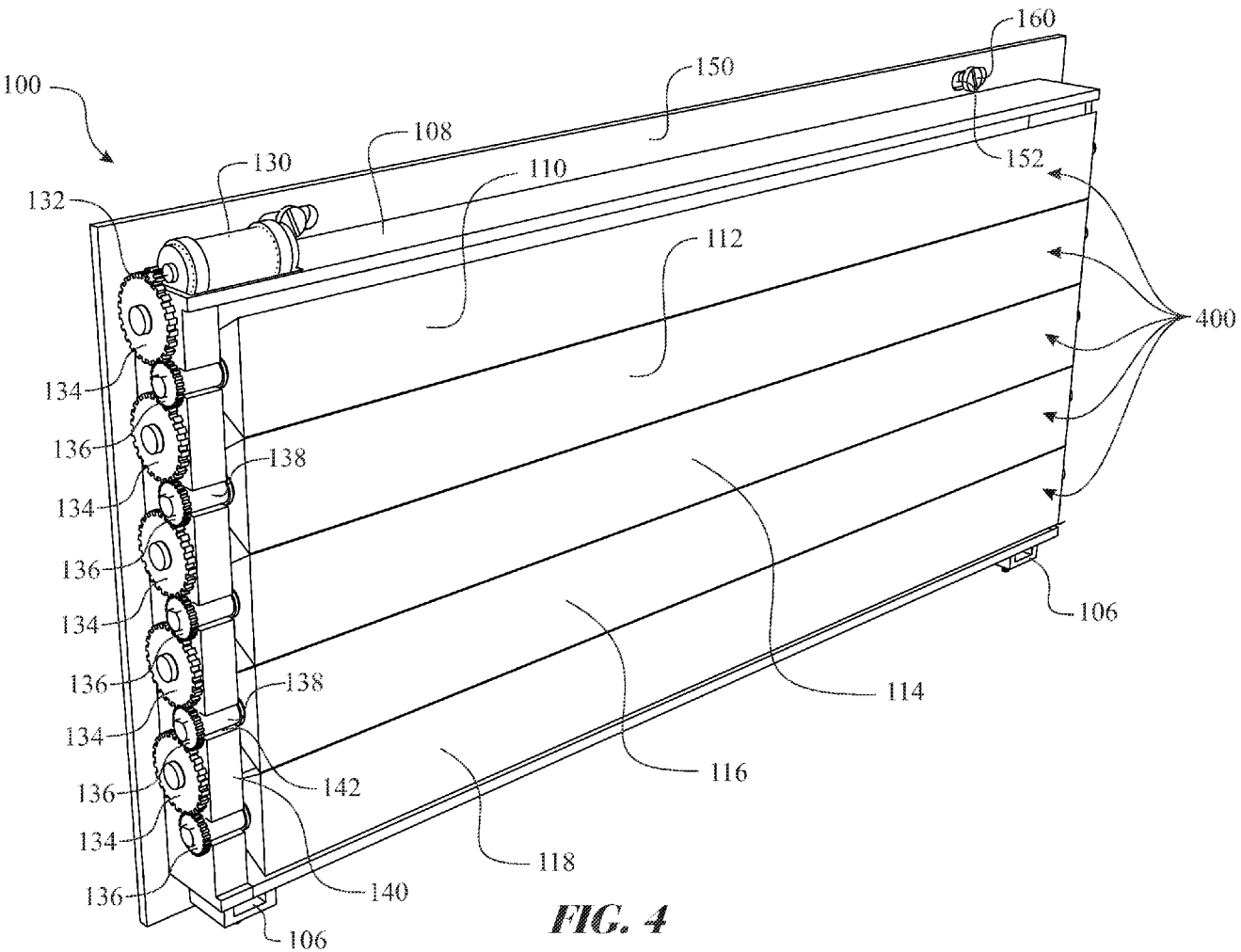
FIG. 4 illustrates a perspective front view of the functional components assembled within an inner frame based upon the illustrative embodiment of the multi-image license plate assembly presented in FIG. 2.
Figure 5:
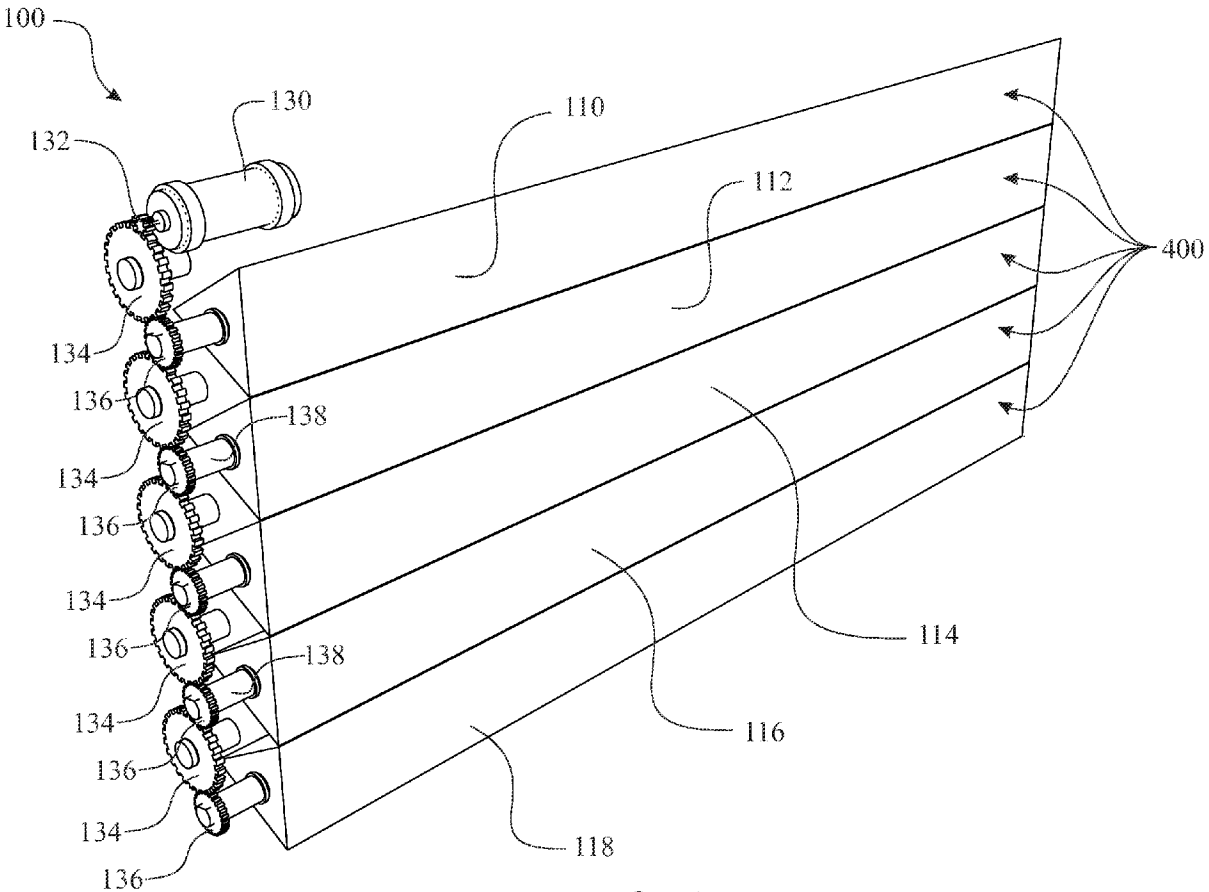
FIG. 5 illustrates a perspective front view of the functional components removed from the inner frame of the multi-image license plate assembly presented in FIG. 2.

The present disclosure is generally directed to a multi-image license plate assembly 100 as illustrated in FIGS. 2 through 5. The multi-image license plate assembly 100 includes an assembly front cover 104 assembled to an assembly housing 102, enclosing the functional components. An inner frame 108, including a shaft assembly supporting subsection 140, provides an assembly support frame for the functional components as illustrated in FIG. 4. The assembly housing 102 can be formed about the perimeter of the inner frame 108, as part of the assembly front cover 104, or as a separate component. A series of rotational member shaft slots 142 can be formed within a shaft assembly supporting subsection 140 of the inner frame 108. A series of rotational member assemblies 400 are rotationally assembled to the shaft assembly supporting subsection 140 by placing an axle-like feature, such as a rotational member axle 144 and rotational member gear shaft bushing 138, into each of the respective rotational member shaft slot 142. The rotational member gear shaft bushing 138 is secured within the rotational member shaft slot 142 via a plate (or similar) placed along the exposed edge of the shaft assembly supporting subsection 140. One such enclosure can be incorporated into the assembly housing 102 or assembly front cover 104 or can be a separate plate fastened to the assembly housing 102.

Figure 7:
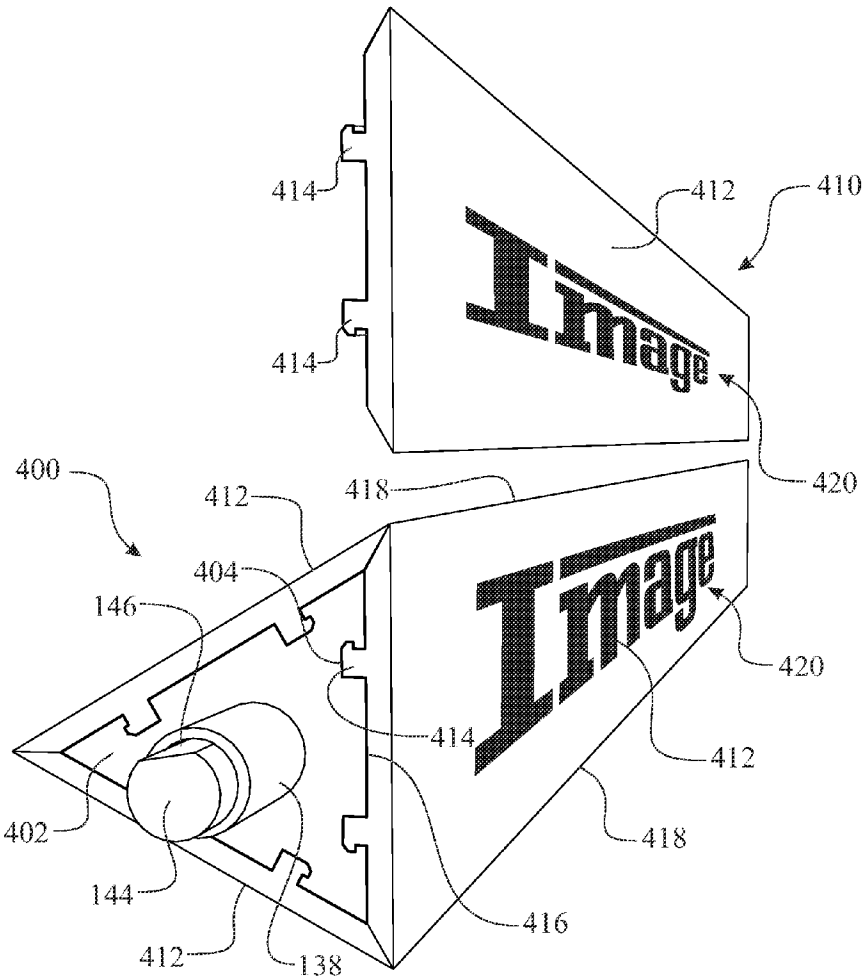
FIG. 7 illustrates a perspective view of an exemplary embodiment of a rotating display member assembly for use with the multi-image license plate assembly of FIG. 2.
Figure 8:
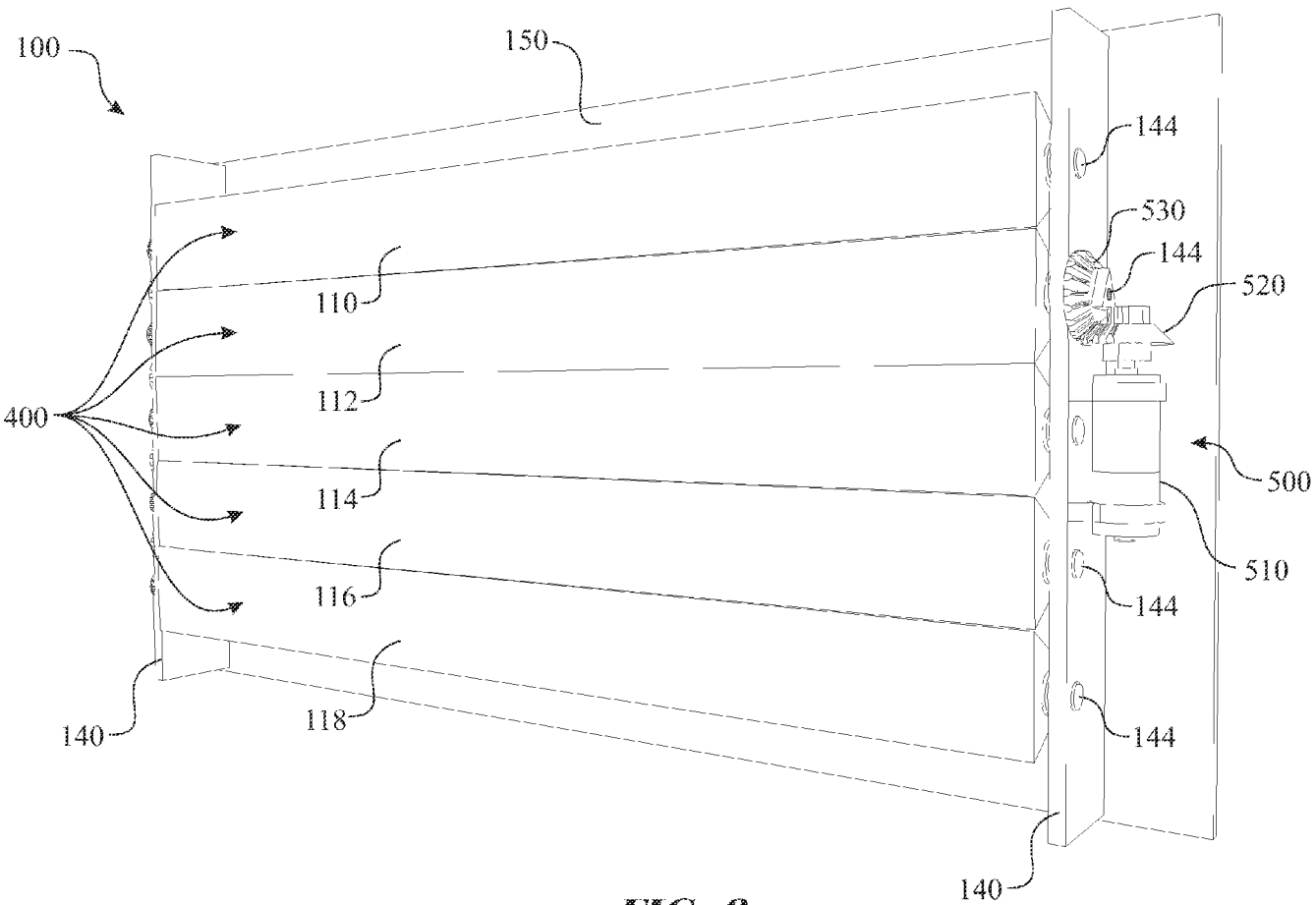
FIG. 8 illustrates a perspective front view of the functional components assembled within the inner frame based focusing on an incorporated alternate drive interface.
Figure 9:
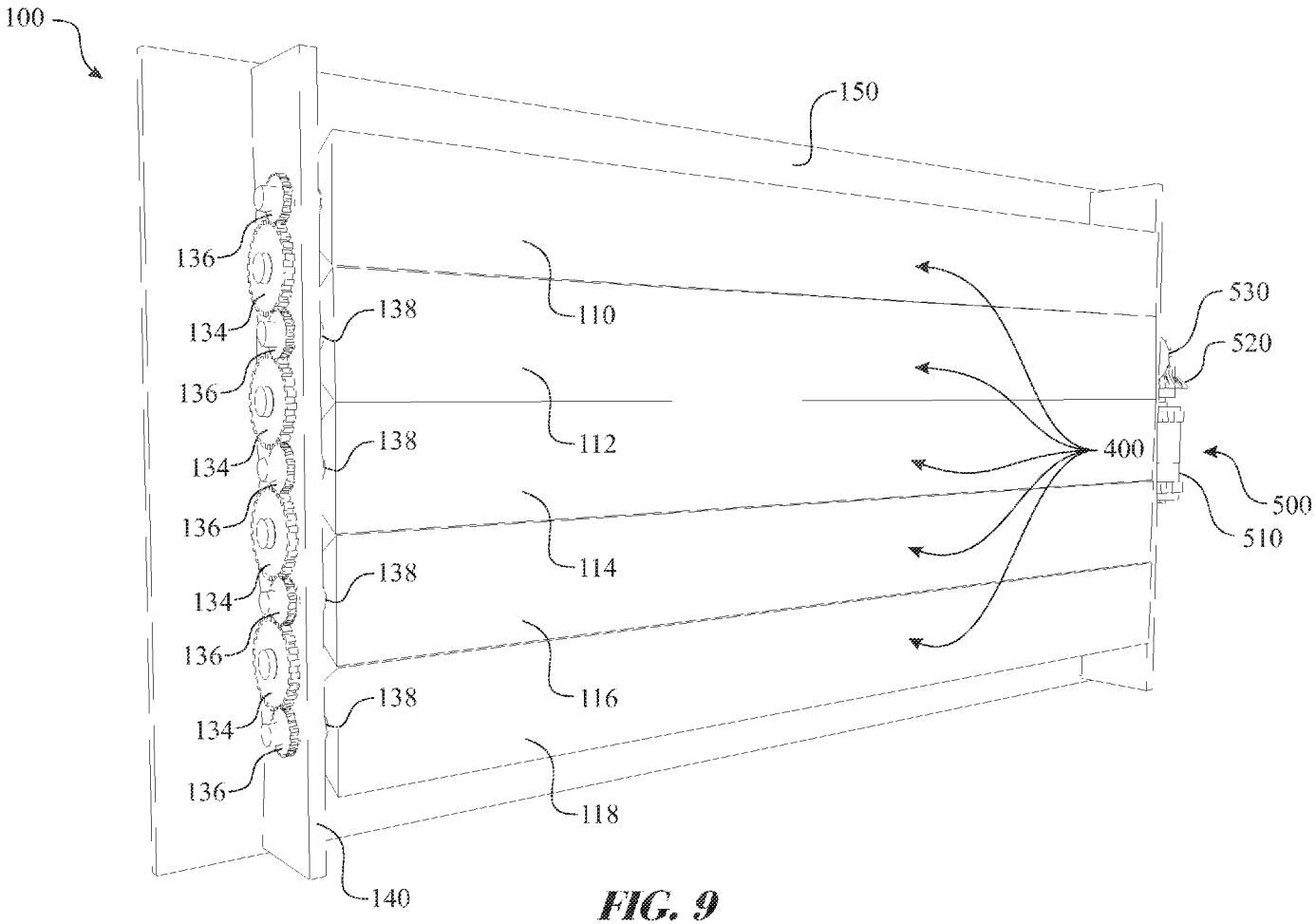
FIG. 9 illustrates a perspective front view of the functional components assembled within the inner frame based focusing on a gear drive train operationally controlled by the alternate functional drive mechanism.
Figure 10:
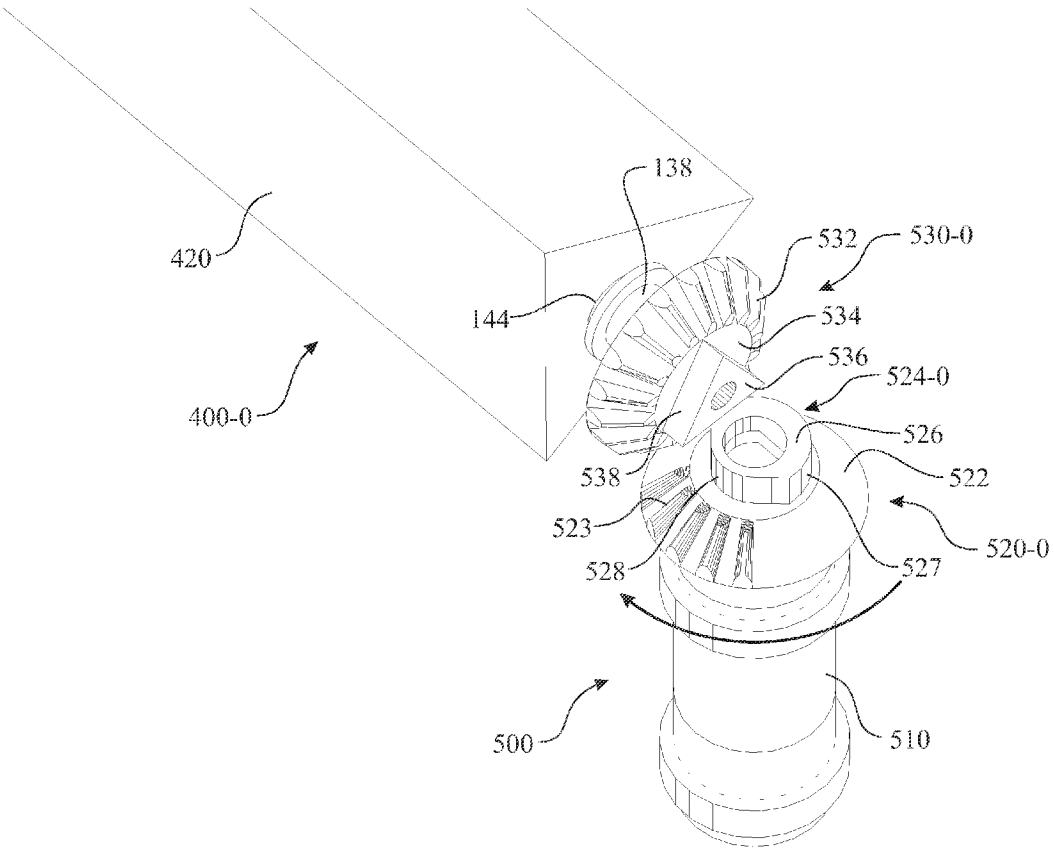
FIG. 10 illustrates a detailed isometric view of the alternate drive interface, positioned in a sustain first image presentation configuration.

An exemplary embodiment of the rotational member assembly 400 is detailed in FIG. 7. The rotational member assembly 400 includes a rotational member axle 144 assembled having a rotational axis aligned with a longitudinal centerline of the rotational member assembly 400. A keying feature, such as a knurled axle key surface 146, is preferably formed within the rotational member axle 144 ensuring a rotational member gear 136 (FIG. 4) remains properly registered to the rotational member assembly 400. A rotational member gear shaft bushing 138 can be provided for reducing friction, being slipped over the rotational member axle 144. The rotational member assembly 400 is preferably formed having a rotational display frame member 402 with three rotational member image receiving surfaces 416. The rotational member image receiving surfaces 416 are formed being concentric about a longitudinal centerline. The rotational member image receiving surface 416 can be a planar surface or incorporate features for coupling an image insert 410. An image such as image 420 can be applied directly to the rotational member image receiving surface 416 or onto an image surface 412 of the image insert 410. The image insert 410 is then assembled onto the rotational member image receiving surface 416 (as illustrated). In the illustrated example, the image insert 410 includes a pair of image insert securing tabs 414, which are slideably assembled into a respective pair of insert coupling receptacle 404 formed within the rotational member image receiving surface 416.

The series of rotational member assemblies 400 are assembled in a parallel, horizontal configuration, abutting adjacent image surface mating edge 418 (FIG. 7). A segment of the image is applied to each of the respective rotational member assembly 400 of the series. In the exemplary embodiment, the multi-image license plate assembly 100 includes five (5) rotational member assemblies 400, including a upper rotational member 110, a second rotational member 112, a center rotational member 114, a fourth rotational member 116, and a lower rotational member 118. A plurality of torque translation gears 134 are assembled to the multi-image license plate assembly 100 by placing an axle of the torque translation gears 134 into holes provided within the shaft assembly supporting subsection 140. The rotational member assemblies 400 are then assembled to the multi-image license plate assembly 100 by placing rotational member gear shaft bushings 138 over each of a gear end and a free spinning end of the rotational member axle 144. A rotational member gear 136 is assembled to the gear end of the rotational member assembly 400, and the rotational member assemblies 400 is placed into the rotational member shaft slot 142. Teeth of the rotational member gear 136 engage with teeth of the torque translation gear 134. Each of the rotational member assemblies 400 is inserted into the respective rotational member shaft slot 142. The rotational member assemblies 400 are held in proper registration respective to the complete series of rotational member assemblies 400 ensuring the image segments remain in registration during the rotating process. The series of gears 134, 136 create a single rotational drive system engaging with a motor gear 132 attached to a motor 130. The motor gear 132 can be a single gear or a series of gears forming a torque converter. The motor 130 is mounted to the inner frame 108 (as shown) or the housing rear surface and mounting flange 150. The motor 130 is preferably a DC driven stepper motor. Although the exemplary embodiment utilises a series of five (5) rotational member assemblies 400, it is recognized that any reasonable number of rotational member assemblies 400 can be used. A sensor, a stepper motor counting sequence, and the like can be deployed to determine when the series of rotational member assemblies 400 are properly rotated placing the edges 418 into proper alignment.

Figure 1:
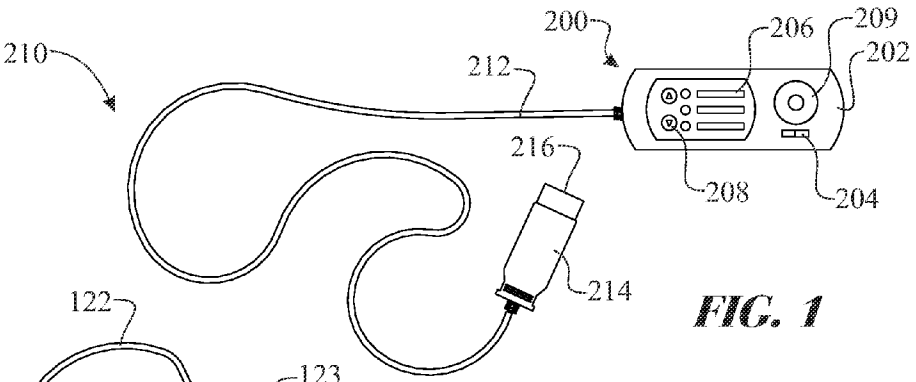
FIG. 1 illustrates an exemplary illustration of a remote control apparatus for remotely rotating the assembly between a displayed image and an adjacent image.
Figure 2:
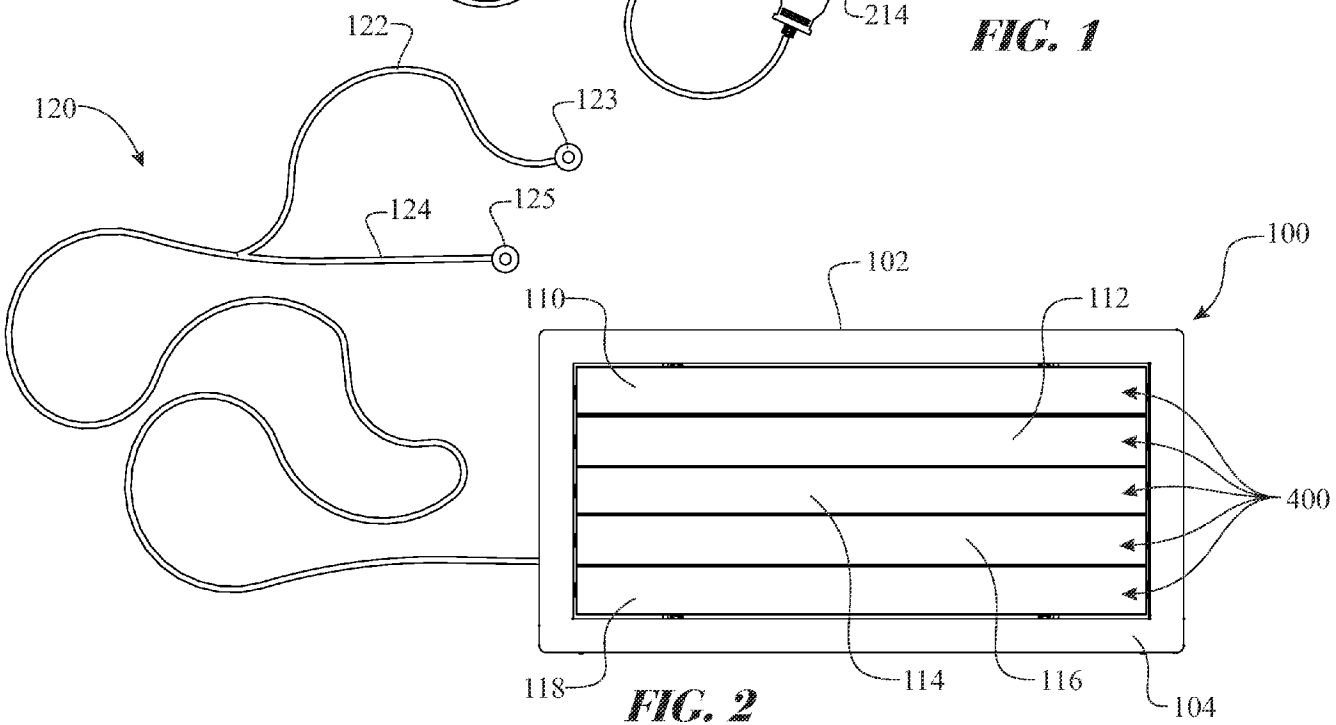
FIG. 2 illustrates an elevation front view of an exemplary embodiment of a multi-image license plate assembly.

Power is preferably provided to the multi-image license plate assembly 100 via a power cabling 120 coupled to the vehicles power system. The power cabling 120 includes a positive power cable 122 having a positive power terminal connector 123 and a negative power cable 124 having a negative power terminal connector 125. Although the preferred design utilises the vehicle's power, it is recognized the multi-image license plate assembly 100 can be powered via a portable power source such as batteries, solar power, capacitors, wind generated power, and the like. The portable power source can be incorporated within the primary assembly, housed in a separate battery box mounted on the vehicle, or mounted in any other reasonable manner respective to the form factor of the power supply. A signal controller can be included, such as the exemplary embodiment illustrated in FIG. 1, for providing operational control of the multi-image license plate assembly 100. The signal controller includes an operational control assembly 200, which communicates with the multi-image license plate assembly 100 via a signal cable assembly 210. The operational control assembly 200 comprises a control assembly housing 202 having a power button 204, a series of position indicators 206, and a rotational direction control 208. An optional timer switch 209 can be incorporated, allowing the user to program the multi-image license plate assembly 100 to automatically change the displayed image based upon the programmed time delay. The timer can be set with a single time span or a plurality of time spans. The controlling signal is communicated via the signal cable assembly 210 to the multi-image license plate assembly 100. The signal cable assembly 210 comprises a signal cable 212 in communication with the operational control assembly 200 on a first end and having a signal connector housing 214 on the opposite end. A signal connector 216 is provided within the signal connector housing 214 for electrically connecting the operational control assembly 200 to a mating connector on the multi-image license plate assembly 100. It is understood the operational control assembly 200 can be in signal communication with the multi-image license plate assembly 100 via a wireless transmission.

The user would provide power to the multi-image license plate assembly 100 via the power button 204. The series of rotational member assemblies 400 of the multi-image license plate assembly 100 can be set to be rotated manually, via a factory preset timeframe, or via a programmable timer sequence. The user can direct the rotational member assembly 400 to rotate in a forward or reverse direction via a respective forward or reverse button of the rotational direction control 208. Sensors, software, lights, and the like can be incorporated to indicate the image being presented by the multi-image license plate assembly 100 via the position indicator 206. It is preferred that the operational control assembly 200 be affixed to a vehicle dashboard (not shown, but well understood). An optional motion sensing circuit can be incorporated, determining when the vehicle is stationary or moving. The circuit can additionally sense the status of the engine. The circuit determines when engine is off and/or the vehicle is stationary, and places the multi-image license plate assembly 100 into a sleep mode. The multi-image license plate assembly 100 re-initiates the rotation sequence when the circuit determines that the engine is running and/or the vehicle is in motion.

Figure 6:
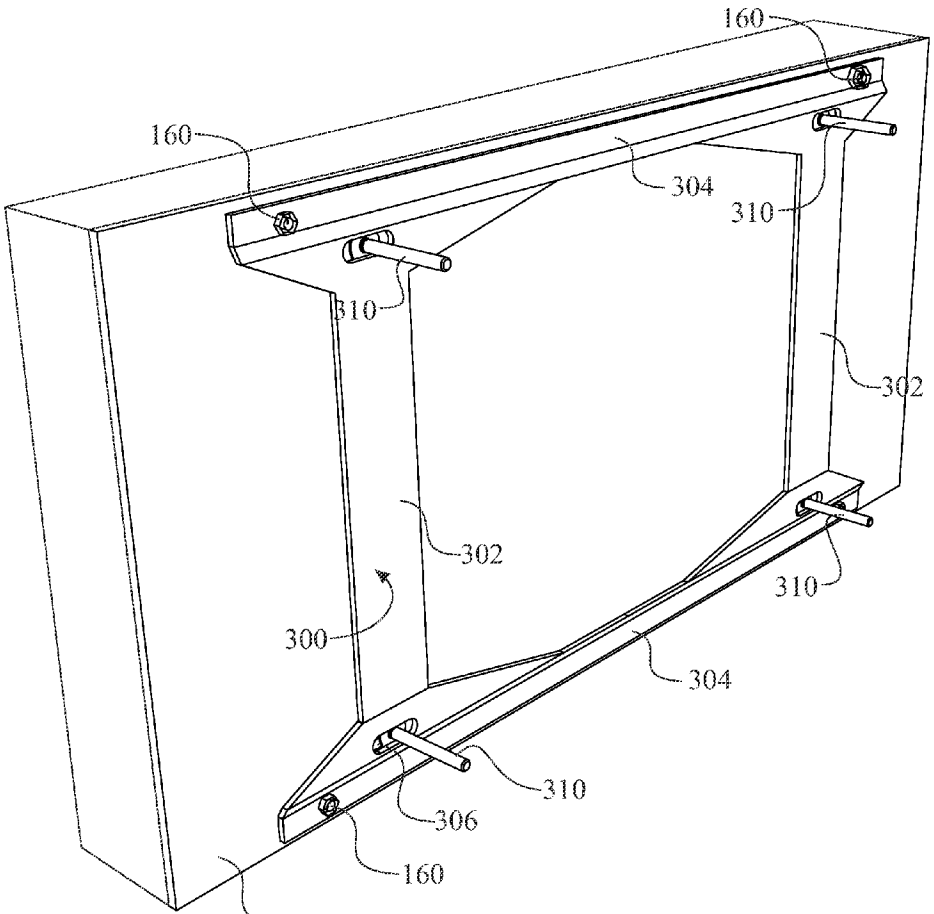
FIG. 6 illustrates a perspective rear view of an exemplary mounting frame and respective mounting hardware for mounting the multi-image license plate assembly to a vehicle.

A housing rear surface and mounting flange 150 is preferably formed about and extending laterally from the periphery of the inner frame 108 for mounting the inner frame 108 to a mounting frame assembly 300 as illustrated in FIG. 6. A plurality of housing mounting slot 152 (FIG. 4) can be disposed through the housing rear surface and mounting flange 150 providing clearance for a housing mounting fastener 160. The housing mounting fastener 160 is used to secure the housing rear surface and mounting flange 150 directly to the vehicle or to a mounting frame assembly 300 as illustrated in FIG. 6. The mounting frame assembly 300 provides an adapter between the multi-image license plate assembly 100 and the vehicle (not shown, but well understood). The mounting frame assembly 300 is preferably formed having a pair of vertical frame section 302 and a pair of horizontal frame section 304. The mounting frame assembly 300 includes a series of mounting frame fastener slot 306 mimicking the mounting configuration of a standard license plate. A mounting frame fastener 310 is inserted through each respective mounting frame fastener slot 306 for fastening the mounting frame assembly 300 to the vehicle. The assembly housing 102 is assembled to the inner frame 108 or housing rear surface and mounting flange 150 via any mechanical fastening system; preferably via a snap-lock feature, such as a tab that would insert into a plurality of front cover clip receptacles 106 (FIG. 4). If the assembly front cover 104 is separate from the assembly housing 102, the assembly front cover 104 is then assembled to the assembly housing 102. Alternately, the multi-image license plate assembly 100 can include an adaptive mounting form factor within the assembly housing 102 to directly mount the assembly 100 to the vehicle.

The fabrication cost is minimized by designing the components and assembly for manufacturability. The assembly housing 102 and assembly front cover 104 are formed of a molded plastic. The inner frame 108 is fabricated of a molded plastic, forming the rotational member shaft slot 142, front cover clip receptacles 106, housing rear surface and mounting flange 150, and other features within the shaft assembly supporting subsection 140 section of the inner frame 108. The rotational member assembly 400 is an assembly using components that are preferably fabricated of an extruded material and cut to length. The rotational display frame member 402, the rotational member axle 144, and the image insert 410 can all be fabricated using an extruding process. It is understood that the rotational member axle 144 can be fabricated separately by any axle manufacturing means, including extrusion, rolling, cold rolling, and the like. The rotational member axle 144 can be inserted through a tubular aperture located through the rotational display frame member 402. Alternately, a pair of short, rotational member axles 144 can be inserted into receptacles located at each end of the rotational display frame member 402. The gears 134, 136 can be fabricated using an extruding process, sheared to the desired thickness. Other components, such as the motor 130, the fasteners 160, 310, the rotational member gear shaft bushing 138, the wiring, and the like are preferably off the shelf components. Each can be fabricated of plastic, metal, or any other selected material. The assembly is generally insertion and snap fasteners.

It is recognized that although a series of gears 134, 136 are illustrated as a means for rotating the rotational member assembly 400, any number of rotation drive designs can be used. This includes a cable drive system, a chain drive system, a belt drive system, a worm gear drive system, a friction drive system, and the like.

A second such exemplary rotation drive design can be integrated as illustrated in FIGS. 8 through 16. The second exemplary embodiment utilizes a drive assembly 500. The drive assembly 500 includes a novel gear configuration comprising a motor segmented gear 520 driven by a drive motor 510, the motor segmented gear 520 engaging with a rotational member gear 530. The rotational member gear 530 is mechanically attached to the rotational member axle 144, which governs the rotated orientation of the rotational member assembly 400. The series of gears 134, 136, as previously described, maintain the rotational members 110, 112, 114, 116, 118 in rotational unison.

The sequence of a ⅓ rotation using the novel gear configuration 520, 530 is demonstrated in FIGS. 10 through 16. The rotational member assembly 400 rotates by 120 degrees (⅓ of a complete rotation), changing which of three images 420 are displayed, thus changing the displayed image. The motor segmented gear 520 engages with the rotational member gear 530 to rotate the rotational member assembly 400 in 120 degree increments. A drive gear rotational member stabilizing cam 524 is formed upon an axial end of the motor segmented gear 520. The drive gear rotational member stabilizing cam 524 engages with a three position display stabilizing cam 536 formed upon an axial end of the rotational member gear 530. The steps of motion of each of the motor segmented gear 520, drive gear rotational member stabilizing cam 524, rotational member gear 530, and rotational member assembly 400 are defined by a suffix.

The motor segmented gear 520 is fabricated having a drive gear toothed section 523 spanning approximately 120 degrees of the circumference of a conical surface of the motor segmented gear 520. A drive gear tooth-free section 522 is provided about the balance of the circumference of the motor segmented gear 520. A series of rotational member gear teeth 532 are spatially distributed about a circumference of a conical surface of the rotational member gear 530. The drive gear toothed section 523 periodically engage with the rotational member gear teeth 532 wherein engagement occurs during ⅓ of the rotation of drive motor 510 and the drive motor 510/motor segmented gear 520 rotates freely during ⅔ of the rotation of the drive motor 510. The illustrated design is provided for a three-sided object. It is understood the ratio of teeth to bare surface can vary respective to the number of sides to be displayed.

The drive gear rotational member stabilizing cam 524 is fabricated having a stabilizing surface 526, a stationary display broad radius cam section 527 and a display rotating narrow cam section 528. The ratio of the circumferential length of the stationary display broad radius cam section 527 to the display rotating narrow cam section 528 defines the time desired to stabilize the image 420 in a display orientation. The display rotating narrow cam section 528 is oriented to correspond with the drive gear tooth-free section 522. The three position display stabilizing cam 536 is shaped comprising three planar sidewall surfaces referred to as a stabilizing cam engaging edge surface 538, the number corresponding with the number of desired stop positions. It is understood that the number of planar sidewall surfaces 538 is respective to the number of sides of the rotational member assembly 400. The exemplary three-position display stabilizing cam 536 is formed in a triangular shape in the exemplary embodiment to correlate with the triangular shaped rotational member assembly 400. The stabilizing cam engaging edge surface 538 rides atop the stabilizing surface 526, stabilizing the rotational member assembly 400 in a display orientation. The stationary display broad radius cam section 527 is positioned under the three position display stabilizing cam 536, wherein a planar gear upper surface 534 of the rotational member gear 530 provides clearance for the three position display stabilizing cam 536 during rotation.

Figure 11:
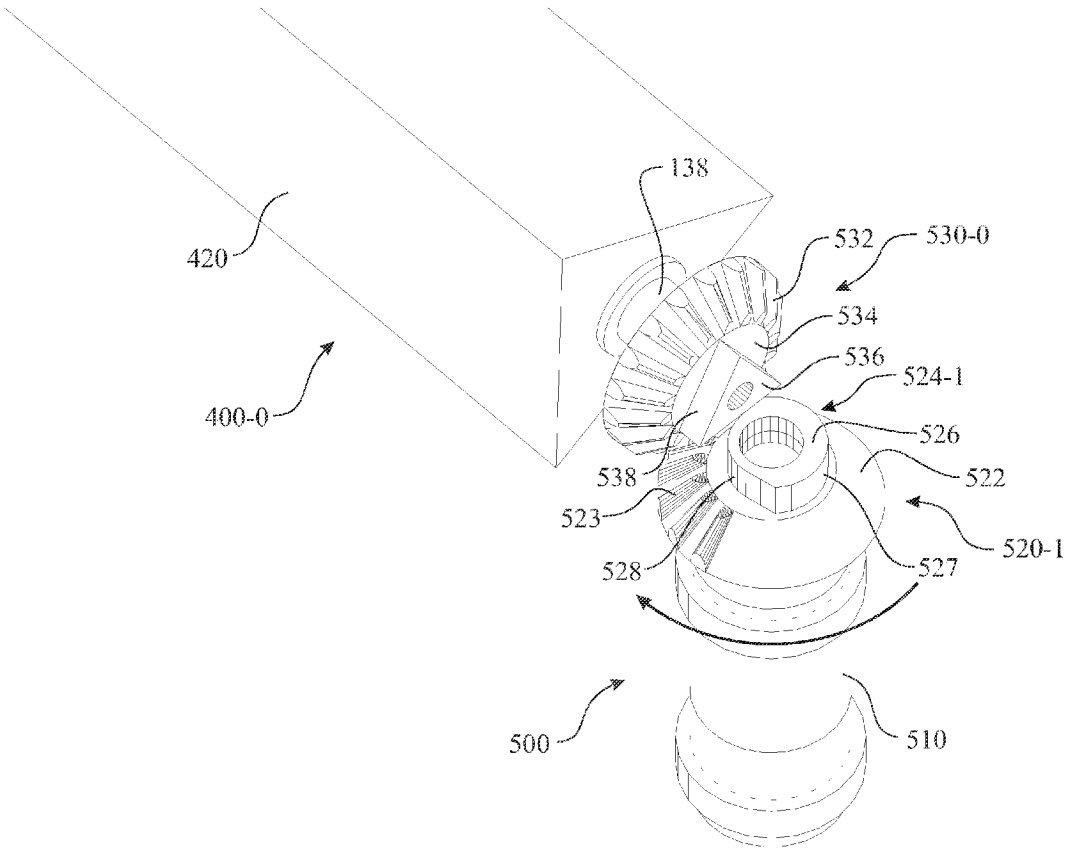
FIG. 11 illustrates a detailed isometric view of the alternate drive interface, positioned in a release sustain of the first image presentation configuration.
Figure 12:
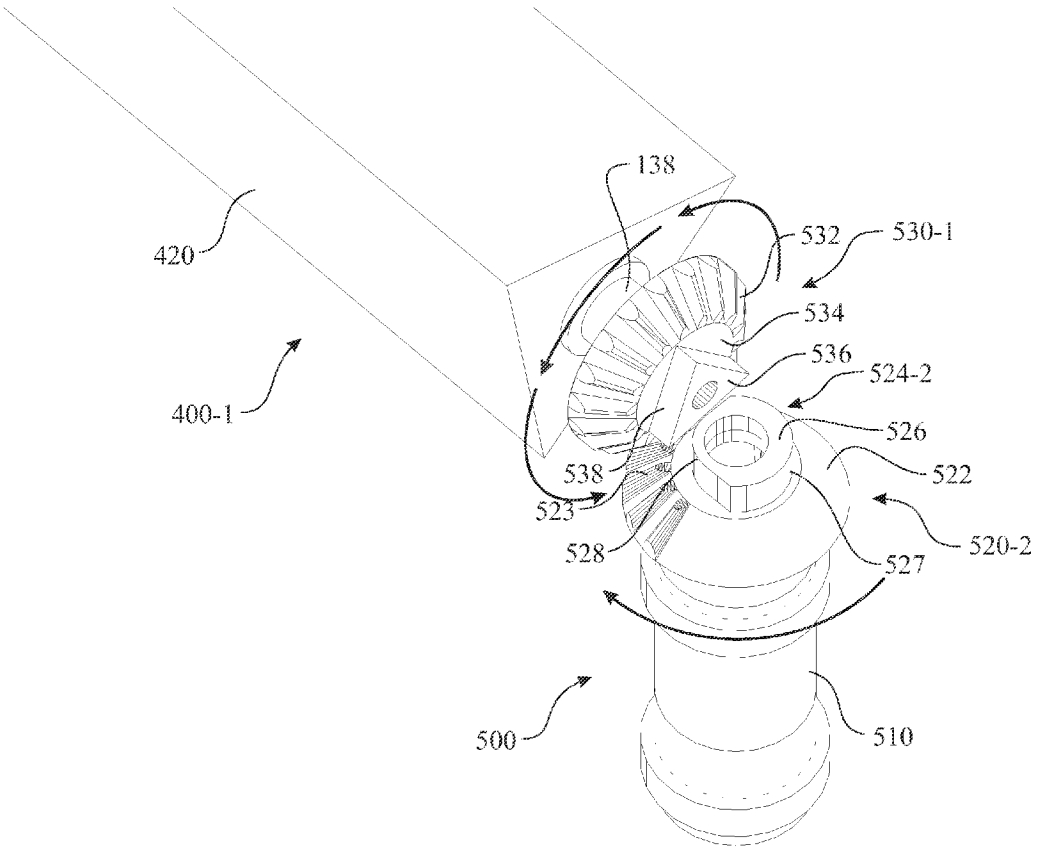
FIG. 12 illustrates a detailed isometric view of the alternate drive interface, positioned in a begin transition from the first image presentation configuration.
Figure 13:
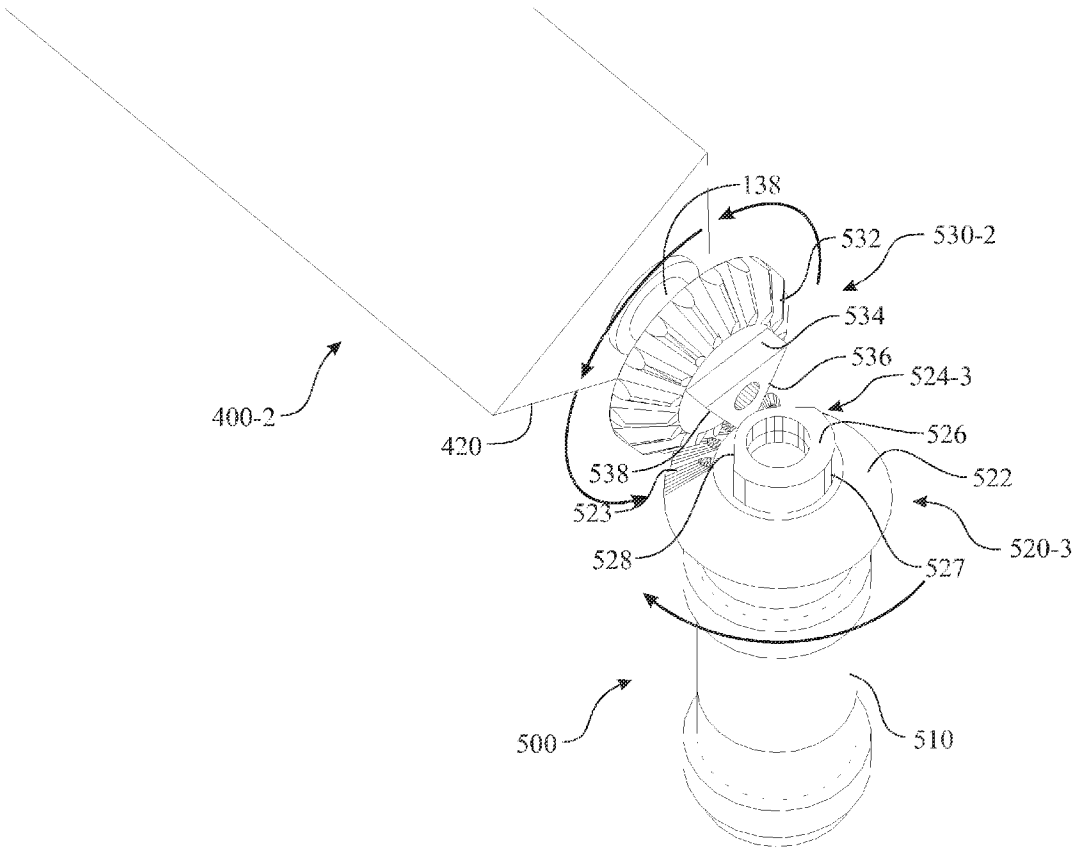
FIG. 13 illustrates a detailed isometric view of the alternate drive interface, positioned in a partially complete transition between the first image presentation configuration and a second image presentation configuration.

The drive motor 510 rotates the motor segmented gear 520, which rotates the drive gear rotational member stabilizing cam 524 respectively. The stabilizing surface 526 of the drive gear rotational member stabilizing cam 524 supports and prevents the stabilizing cam engaging edge surface 538 from rotating. When the drive gear rotational member stabilizing cam 524 rotates to transition from the stationary display broad radius cam section 527 to the display rotating narrow cam section 528, the three position display stabilizing cam 536 begins to rotate. The positions are referenced as drive gear rotational member stabilizing cam 524-1, motor segmented gear 520-1, and rotational member gear 530-0 as illustrated in FIG. 11. The stabilizing cam engaging edge surface 538 transitions between a supported configuration and an unsupported configuration. Simultaneously, the drive gear toothed section 523 engages with the rotational member gear teeth 532 causing the rotational member gear 530 and respective rotational member assembly 400 to begin to rotate. The three position display stabilizing cam 536 rotates into the clearance provided by the display rotating narrow cam section 528. The position is referenced by the motor segmented gear 520-2/drive gear rotational member stabilizing cam 524-2 beginning to rotate the rotational member gear 530-1 which in turn rotates the rotational member assembly 400-1 via the rotational member axle 144 as illustrated in FIG. 12. The rotation continues as the drive gear toothed section 523 continues to engage with the rotational member gear teeth 532. The three position display stabilizing cam 536 passes across the display rotating narrow cam section 528. The position is referenced by the motor segmented gear 520-3/drive gear rotational member stabilizing cam 524-3 continuing to rotate the rotational member gear 530-2 which in turn rotates the rotational member assembly 400-2 as illustrated in FIG. 13. The rotation begins to transition into a second support position as the stationary display broad radius cam section 527 begins to reengage with the stabilizing cam engaging edge surface 538. The rotation of the motor segmented gear 520 approaches a position where the drive gear toothed section 523 are disengaging with the rotational member gear teeth 532. The position is referenced by the motor segmented gear 520-4/drive gear rotational member stabilizing cam

Figure 14:
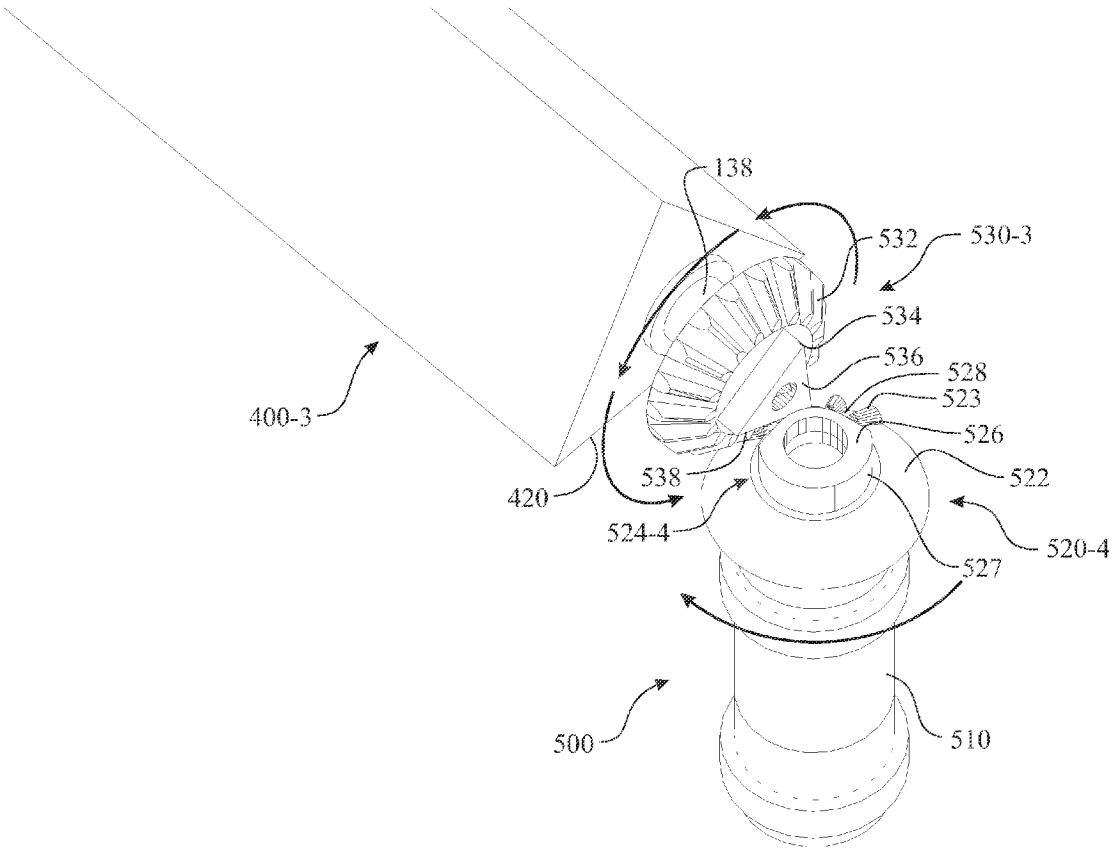
FIG. 14 illustrates a detailed isometric view of the alternate drive interface, positioned nearing completion of the transition between the first image presentation configuration and a second image presentation configuration.
Figure 15:
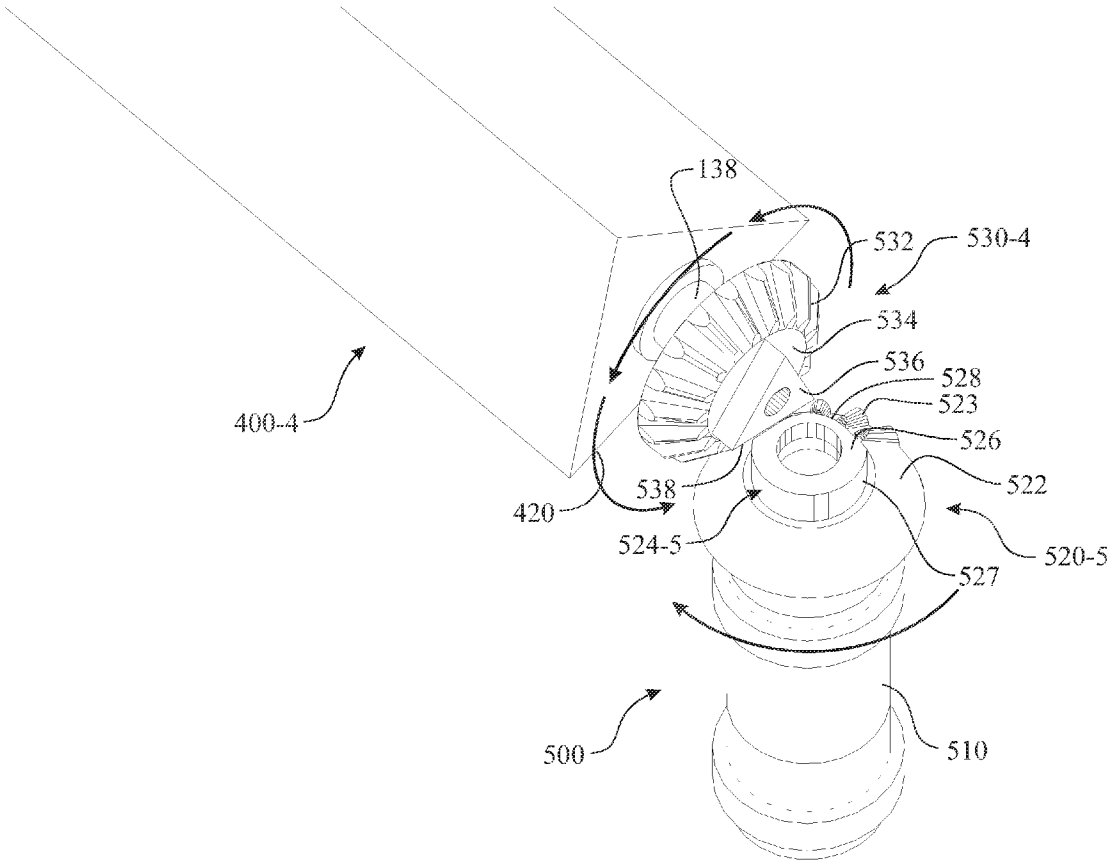
FIG. 15 illustrates a detailed isometric view of the alternate drive interface, positioned transitioning into a sustain second image presentation configuration.
Figure 16:
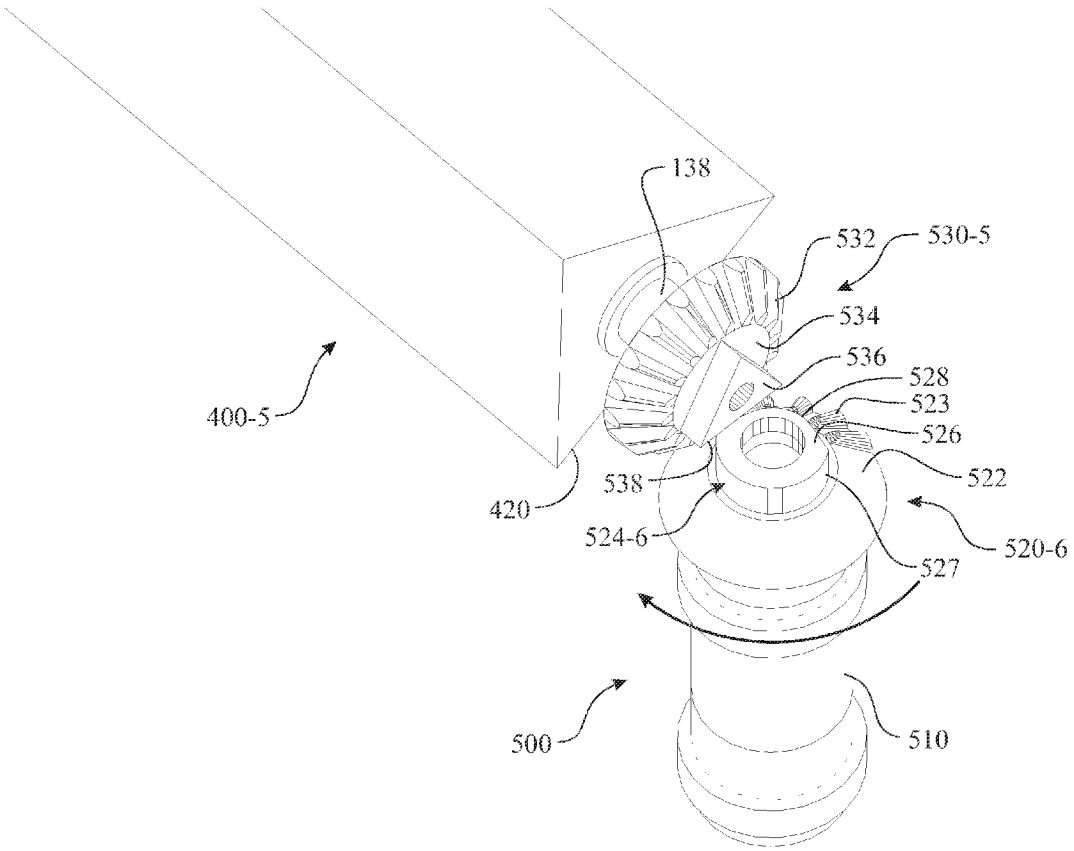
FIG. 16 illustrates a detailed isometric view of the alternate drive interface, positioned in the sustain second image presentation configuration.

524-4 finalizing a rotation of the rotational member gear 530-3 which in turn rotates the rotational member assembly 400-3 as illustrated in FIG. 14. The rotation continues to transition into a second support position as the stabilizing cam engaging edge surface 538 seats upon the stabilizing surface 526. The rotation of the motor segmented gear 520 disengages the drive gear toothed section 523 from the rotational member gear teeth 532. The position is referenced by the motor segmented gear 520-5/drive gear rotational member stabilizing cam 524-5 finalizing a rotation of the rotational member gear 530-4 which in turn rotates the rotational member assembly 400-4 as illustrated in FIG. 15. The rotation finalizes the transition to a second support position. The rotation of the drive gear rotational member stabilizing cam 524 finalizes seating the stabilizing cam engaging edge surface 538 upon the stabilizing surface 526. The position is referenced by the motor segmented gear 520-6/drive gear rotational member stabilizing cam 524-6 completing a rotation of the rotational member gear 530-5 which in turn rotates the rotational member assembly 400-5 as illustrated in FIG. 16.

Deviations from the disclosed teachings should still be considered as a component of the present invention. Although a wired interface is shown, providing signal communication between the operational control assembly 200 and the multi-image license plate assembly 100, it is understood that a wireless communication means can be utilized.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence

What is claimed is:

1. A multi-image license plate assembly comprising: an assembly frame having a viewing side and being sized approximate to a standard license plate; a series of rotating display members, each rotating display member having a rotational axis disposed along a longitudinal center of each rotating display member; each rotating display member being disposed having the longitudinal axis oriented horizontally within said assembly frame; a rotational member gear attached to a transmission end of each rotating display member, wherein the rotational member gear rotates about the display member longitudinal axis; each rotating display member having a plurality of image surfaces, wherein a lower image surface edge abuts an upper image surface edge of an adjacent image surface to provide a planar surface finish; at least one visual image divided into segments with each segment disposed upon a respective image surface of the series of rotating display members, presenting the visual image when the rotating display members are positioned accordingly; each of the rotating display members being rotatably assembled to the frame in a parallel arrangement positioning a rotation drive ends in a substantially planar arrangement; a plurality of torque translation gears are rotationally assembled to the flame wherein each torque translation gear is in operational engagement between each pair of adjacently positioned rotational member gears, wherein the torque translation gear rotates about an axis parallel to the display member longitudinal axis enabling one rotating display member to transfer a torque to an adjacent rotating display member via the torque translation gear assembled therebetween, thus rotating the series of rotating members in a synchronized fashion for presenting a series of different images; a drive motor provided in operational communication with one of: one of the torque translation gear or one of the rotational member gear; and a mount for fastening said assembly flame to a license plate mount of a vehicle.

2. A multi-image license plate assembly as recited in claim 1, the torque translation gear having a first diameter; and the rotational member gear having a second diameter, wherein the first diameter is larger than the second diameter.

3. A multi-image license plate assembly as recited in claim 2, further comprising a motor gear attached to the drive motor, the motor gear operationally engaging with the series of rotational drive gears.

4. A multi-image license plate assembly as recited in claim 1, the assembly further comprising a remote control, wherein the remote control is designed to allow the user to operate the assembly from within an interior of the vehicle.

5. A multi-image license plate assembly as recited in claim 1, the visual image segments are attached to the respective image surface of the series of rotating display members using one of:

an adhesive interface, and a slideable interface.

6. A multi-image license plate assembly as recited in claim 1, the rotational drive mechanism further comprising:

a motor segmented gear comprising a motor segmented gear toothed section and a motor segmented gear tooth-free section; and a rotational member gear comprising a series of rotational member gear teeth disposed about the circumference of the rotational member gear, the rotational member gear being operationally engaged with the motor segmented gear, wherein the rotational member gear rotates when the motor segmented gear toothed section engages with the rotational member gear teeth and maintains in a display position when the motor segmented gear tooth-free section passes across the rotational member gear teeth.

7. A multi-image license plate assembly as recited in claim 6, the rotational drive mechanism further comprising:

a drive gear rotational member stabilizing cam extending axially from a distal end of the motor segmented gear, the stabilizing cam having a stationary display broad radius cam section and a display rotating narrow cam section about a circumference and a stabilizing surface provided as a distal surface; and a multi-position display stabilizing cam extending axially from a distal end of the rotational member gear having a plurality of equilateral stabilizing cam engaging edge surfaces formed in a contiguous peripheral shape wherein the number of equilateral stabilizing cam engaging edge surfaces equals the number of image surfaces, wherein the stabilizing cam engaging edge surfaces are supported by the stabilizing surface to maintain the rotating member in a display orientation and wherein the three position display stabilizing cam rotates when aligned with the display rotating narrow cam section.

8. A multi-image license plate assembly comprising:

an assembly frame having a viewing side and being sized approximate to a standard license plate;

a series of rotating display members, each rotating display member having a rotational axis disposed along a longitudinal center of each rotating display member;

each rotating display member being disposed having the longitudinal axis oriented horizontally within said assembly frame;

a rotational member gear attached to a transmission end of each rotating display member, wherein the rotational member gear rotates about the display member longitudinal axis;

each rotating display member having three image surfaces, wherein a lower image surface edge abuts an upper image surface edge of an adjacent image surface to provide a planar surface finish;

at least one visual image divided into segments with each segment disposed upon a respective image surface of the series of rotating display members, presenting the visual image when the rotating display members are positioned accordingly;

each of the rotating display members being rotatably assembled to the frame in a parallel arrangement positioning a rotation drive ends in a substantially planar arrangement;

a plurality of torque translation gears are rotationally assembled to the flame wherein each torque translation gear is in operational engagement between each pair of adjacently positioned rotational member gears, wherein the torque translation gear rotates about an axis parallel to the display member longitudinal axis enabling one rotating display member to transfer a torque to an adjacent rotating display member via the torque translation gear assembled therebetween, thus rotating the series of rotating members in a synchronized fashion for presenting a series of different images;

a drive motor comprising a rotating axle;

a motor segmented gear assembled to the motor rotating axle;

a rotational member gear attached to a drive end of one rotating display member, the drive end being located opposite the transmission end, the rotational member gear being in operational engagement with the motor segmented gear and the respective rotating display member transferring a torque to the remaining rotating display members of the series of rotating display members by way of the inter-engaging torque translation gear and rotational member gear;

and a mount for fastening said assembly frame to a license plate mount of a vehicle.

9. A multi-image license plate assembly as recited in claim 8, the torque translation gear having a first diameter; and the rotational member gear having a second diameter, wherein the first diameter is larger than the second diameter.

10. A multi-image license plate assembly as recited in claim 9, further comprising a motor gear attached to the drive motor, the motor gear operationally engaging with the series of rotational drive gears.

11. A multi-image license plate assembly as recited in claim 8, the assembly further comprising a remote control, wherein the remote control is designed to allow the user to operate the assembly from within an interior of the vehicle.

12. A multi-image license plate assembly as recited in claim 8, the visual image segments are attached to the respective image surface of the series of rotating display members using one of:

an adhesive interface, and a slideable interface.

13. A multi-image license plate assembly as recited in claim 8, the rotational drive mechanism further comprising:

a motor segmented gear comprising a motor segmented gear toothed section and a motor segmented gear tooth-free section; and a rotational member gear comprising a series of rotational member gear teeth disposed about the circumference of the rotational member gear, the rotational member gear being operationally engaged with the motor segmented gear, wherein the rotational member gear rotates when the motor segmented gear toothed section engages with the rotational member gear teeth and maintains in a display position when the motor segmented gear tooth-free section passes across the rotational member gear teeth.

14. A multi-image license plate assembly as recited in claim 13, the rotational drive mechanism further comprising:

a drive gear rotational member stabilizing cam extending axially from a distal end of the motor segmented gear, the stabilizing cam having a stationary display broad radius cam section and a display rotating narrow cam section about a circumference and a stabilizing surface provided as a distal surface; and a three position display stabilizing cam extending axially from a distal end of the rotational member gear having three equilateral stabilizing cam engaging edge surfaces formed in a triangular shape, wherein the stabilizing cam engaging edge surfaces are supported by the stabilizing surface to maintain the rotating member in a display orientation and wherein the three position display stabilizing cam rotates when aligned with the display rotating narrow cam section.

15. A multi-image license plate assembly comprising:

an assembly frame having a viewing side and being sized approximate to a standard license plate;

a series of rotating display members, each rotating display member having a rotational axis disposed along a longitudinal center of each rotating display member;

each rotating display member being disposed having the longitudinal axis oriented horizontally within said assembly frame;

a rotational member gear attached to a transmission end of each rotating display member, wherein the rotational member gear rotates about the display member longitudinal axis;

each rotating display member having a plurality of image surfaces, wherein a lower image surface edge abuts an upper image surface edge of an adjacent image surface to provide a planar surface finish;

at least one visual image divided into segments with each segment disposed upon a respective image surface of the series of rotating display members, presenting the visual image when a rotating display members are positioned accordingly;

each of the rotating display members being rotatably assembled to the frame in a parallel arrangement positioning the rotation drive ends in a substantially planar arrangement;

a plurality of torque translation gears are rotationally assembled to the flame wherein each torque translation gear is in operational engagement between each pair of adjacently positioned rotational member gears, wherein the torque translation gear rotates about an axis parallel to the display member longitudinal axis enabling one rotating display member to transfer a torque to an adjacent rotating display member via the torque translation gear assembled therebetween, thus rotating the series of rotating members in a synchronized fashion for presenting a series of different images;

a motor segmented gear comprising a motor segmented gear toothed section and a motor segmented gear tooth-free section, the motor segmented gear in operative communication with a drive motor;

and a rotational member gear comprising a series of rotational member gear teeth disposed about the circumference of the rotational member gear, the rotational member gear being attached to a drive end of one rotating display member, the drive end being located opposite the transmission end and is operationally engaged with the motor segmented drive gear, wherein the rotational member gear rotates when the motor segmented gear toothed section engages with the rotational member gear teeth and maintains in a display position when the motor segmented gear tooth-free section passes across the rotational member gear teeth; and a mount for fastening said assembly frame to a license plate mount of a vehicle.

16. A multi-image license plate assembly as recited in claim 15, the rotational drive mechanism further comprising:

a drive gear rotational member stabilizing cam extending axially from a distal end of the motor segmented gear, the stabilizing cam having a stationary display broad radius cam section and a display rotating narrow cam section about a circumference and a stabilizing surface provided as a distal surface; and a three position display stabilizing cam extending axially from a distal end of the rotational member gear having three equilateral stabilizing cam engaging edge surfaces formed in a triangular shape, wherein the stabilizing cam engaging edge surfaces are supported by the stabilizing surface to maintain the rotating member in a display orientation and wherein the three position display stabilizing cam rotates when aligned with the display rotating narrow cam section.

17. A multi-image license plate assembly as recited in claim 15, the series of rotating display members are rotationally synchronized via a series of rotational drive gears engaging between each of the rotating members.

18. A multi-image license plate assembly as recited in claim 15, the assembly further comprising a remote control, wherein the remote control is designed to allow the user to operate the assembly from within an interior of the vehicle.

19. A multi-image license plate assembly as recited in claim 15, the visual image segments are attached to the respective image surface of the series of rotating display members using one of:

an adhesive interface, and a slideable interface.

* * * * *